US011008772B2

(12) United States Patent
Tillotson

(10) Patent No.: US 11,008,772 B2
(45) Date of Patent: May 18, 2021

(54) HAMMOCK TENTS AND RELATED CAMPING SYSTEMS

(71) Applicant: Derek Tillotson, Sandy, UT (US)

(72) Inventor: Derek Tillotson, Sandy, UT (US)

(73) Assignee: Derek Tillotson, Sandy, UT (US)

( * ) Notice: Subject to any disclaimer, the term of this patent is extended or adjusted under 35 U.S.C. 154(b) by 307 days.

(21) Appl. No.: 16/165,943

(22) Filed: Oct. 19, 2018

(65) Prior Publication Data

US 2020/0123801 A1 Apr. 23, 2020

(51) Int. Cl.
*E04H 15/04* (2006.01)
*A45F 3/22* (2006.01)
*A45F 3/52* (2006.01)

(52) U.S. Cl.
CPC ..... *E04H 15/04* (2013.01); *A45F 3/22* (2013.01); *A45F 3/52* (2013.01)

(58) Field of Classification Search
CPC ... A45F 3/22; A45F 3/52; E04H 15/04; E04H 15/324; A47C 29/003; A47C 29/006
See application file for complete search history.

(56) References Cited

U.S. PATENT DOCUMENTS 688,029 A * 12/1901 Mark ..... A45F 3/22 5/121
961,704 A * 6/1910 Palmer ..... A45F 3/22 5/121
1,961,915 A * 6/1934 Salmen, Jr. ..... E04H 15/324 135/153
2,345,377 A * 3/1944 Bowen ..... E04H 15/324 135/125
4,001,902 A 1/1977 Hall et al.
4,320,542 A 3/1982 Cohen
5,240,021 A * 8/1993 Snodgrass ..... E04H 15/425 135/116
5,715,552 A 2/1998 Death
5,913,772 A 6/1999 Clark
(Continued)

FOREIGN PATENT DOCUMENTS

CA 2507775 A1 11/2006
DE 19740849 A1 3/1999
(Continued)

OTHER PUBLICATIONS

"MaverickGear Hammock Tent Review", https://www.youtube.com/watch?v=z7Jzy5kvcDY, Jan. 16, 2017. (Year: 2017).*
(Continued)

*Primary Examiner* — Eric J Kurilla
(74) *Attorney, Agent, or Firm* — TraskBritt

(57) ABSTRACT

A hammock tent comprises a ridgeline and a tent body attached to the ridgeline. The tent body comprises a platform, opposing sides, support structures, and opposing ends. The opposing sides are attached to first opposing edges of the platform. The support structures are attached to the opposing sides, and each comprise ends attached to the ridgeline and an apex proximate a central section of the platform. The opposing ends are positioned between the opposing sides, and are attached to edges of the opposing sides and second opposing edges of the platform. Additional hammock tent and a camping system are also described.

19 Claims, 5 Drawing Sheets

(56) References Cited

U.S. PATENT DOCUMENTS

| | | | | |
|---|---|---|---|---|
| 6,085,767 | A * | 7/2000 | Maslow | E04H 15/30 135/121 |
| 6,185,763 | B1 | 2/2001 | Hennessy | |
| 6,220,264 | B1 | 4/2001 | Newman | |
| 6,389,620 | B1 | 5/2002 | Hennessy | |
| 6,701,549 | B1 | 3/2004 | Eriksen | |
| 6,711,763 | B2 | 3/2004 | Batchelder et al. | |
| 6,851,137 | B2 | 2/2005 | Hennessy | |
| 6,865,757 | B2 | 3/2005 | Hennessy | |
| 7,020,915 | B1 | 4/2006 | Helsdon | |
| 7,699,068 | B2 | 4/2010 | Helsdon | |
| 8,296,880 | B1 | 10/2012 | Hennessy | |
| 8,356,370 | B1 | 1/2013 | Clark et al. | |
| 8,756,729 | B2 | 6/2014 | Clark et al. | |
| 8,936,034 | B2 | 1/2015 | Rhett, Jr. | |
| 9,072,367 | B2 | 7/2015 | Kramer | |
| 9,314,090 | B1 * | 4/2016 | Manning | E04H 15/04 |
| 9,565,924 | B2 | 2/2017 | Macaskill | |
| D796,865 | S | 9/2017 | Haug | |
| 9,788,639 | B2 | 10/2017 | Frazer et al. | |
| 2005/0188460 | A1 * | 9/2005 | O'Brien | A45F 3/22 5/121 |
| 2008/0072944 | A1 * | 3/2008 | Wu | A47C 29/006 135/90 |
| 2008/0302403 | A1 * | 12/2008 | Stewart | E04H 15/04 135/114 |
| 2009/0265851 | A1 * | 10/2009 | Clark | A45F 3/22 5/122 |
| 2011/0017251 | A1 * | 1/2011 | Overbaugh | E04H 15/04 135/90 |
| 2014/0158174 | A1 * | 6/2014 | Rhett, Jr. | E04H 15/34 135/121 |
| 2014/0196209 | A1 | 7/2014 | Macaskill | |
| 2016/0338476 | A1 | 11/2016 | Haug | |
| 2017/0202344 | A1 | 7/2017 | Ressler | |
| 2017/0332769 | A1 | 11/2017 | Stinnett | |
| 2018/0079830 | A1 * | 3/2018 | Waddy | A45F 3/22 |

FOREIGN PATENT DOCUMENTS

| | | | |
|---|---|---|---|
| FR | 2546045 | A1 | 11/1984 |
| FR | 2746272 | A1 | 9/1997 |
| GB | 2493404 | A | 2/2013 |
| KR | 10-1114464 | B1 | 2/2012 |
| KR | 10-1573382 | B1 | 12/2015 |
| WO | 02/04767 | A1 | 1/2002 |

OTHER PUBLICATIONS

International Search Report for International Application No. PCT/US2019/058556 dated Mar. 10, 2020, 3 pages.

International Written Opinion for International Application No. PCT/US2019/058556 dated Mar. 10, 2020, 4 pages.

Citation 1. "Q&A with the Ninox!". Facebook, uploaded Sep. 14, 2018 by Sierra Madre, retrieved Jan. 4, 2021, https://www.facebook.com/228755309377/videos/471800586647219. Document including screenshot images from video included. Cd including video file sent to Examiner by US Postal Service with copy of this PTO/SB/08 form.

Citation 2. "Maverick Gear Hammock Review". The Ultimate Hang, published Apr. 10, 2014 by Derek Hansen, retrieved Jan. 4, 2021, https://www.theultimatehang.com/2014/04/10/maverick-gear-hammock-review/. Copy included.

Citation 3. "BGLux Setup Bonus-standing around." Youtube, uploaded Sep. 18, 2017 by Just Bill Town's End Outdoors, retrieved Jan. 4, 2021, https://www.youtube.com/watch?v=3dylMSrDjgM. Document including screenshot images from video included. CD including video file sent to Examiner by US Postal Service with copy of this PTO/SB/08 form.

Third Party Observation submitted in International Application No. PCT/US2019/058556, dated Dec. 1, 2020, 2 pages.

https://gearjunkie.com/snow-peak-hammock-tent Mar. 9, 2016.

https://gearjunkie.com/rei-qd-air-hammock-tent-review dated; Jul. 21, 2017.

* cited by examiner

HAMMOCK TENTS AND RELATED CAMPING SYSTEMS

TECHNICAL FIELD

The disclosure, in various embodiments, relates generally to hammock tents, and related camping systems. More particularly, embodiments of the disclosure relate to hammock tents including ridgelines, and to related camping systems.

BACKGROUND

Conventional sleeping hammocks (e.g., hammock tents, camping hammocks, etc.) suffer from a number of design deficiencies. For example, many conventional sleeping hammocks provide a non-flat (e.g., curved) sleep surface, which can negatively affect user comfort and support. In addition, conventional sleeping hammocks providing a flat sleep surface (e.g., a level sleeping platform) may lack sufficient structure to provide durability, stability, and/or to adequately distribute tensional forces, resulting in sleeping hammocks that are unstable, uncomfortable, and/or prone to damage. Moreover, many conventional sleeping hammocks require precise hang angles for suspension equipment (e.g., ropes, straps, anchors, etc.) in order to reduce sag and achieve a flat sleep surface. The support structures employed by many conventional sleeping hammocks may also significantly affect the overall weight and/or profile of the sleeping hammocks, making the sleeping hammocks unappealing or impractical for many outdoor activities (e.g., backpacking). Furthermore, conventional sleeping hammocks having relatively reduced weight and/or profile often lack sufficient structural integrity and interior sleep for sustained, long-term use of the sleeping hammocks without sacrifices to durability, stability, and/or comfort.

BRIEF SUMMARY

Embodiments described herein include hammock tents and related camping systems. For example, in accordance with one embodiment described herein a hammock tent comprises a ridgeline and a tent body attached to the ridgeline. The tent body comprises a platform, opposing sides, support structures, and opposing ends. The opposing sides are attached to first opposing edges of the platform. The support structures are attached to the opposing sides, and each comprise ends attached to the ridgeline and an apex proximate a central section of the platform. The opposing ends are positioned between the opposing sides, and are attached to edges of the opposing sides and second opposing edges of the platform.

In additional embodiments, hammock tent comprises a ridgeline and a tent body attached to and configured to be suspended from the ridgeline. The ridgeline comprises one or more of webbing, banding, ribbon, strapping, fabric, cord, cable, and rope. The tent body comprises a fabric platform, opposing fabric sides, opposing fabric ends, parabolic support structures, and one or more fastening structures. The fabric platform exhibits a quadrilateral peripheral shape, and comprises end sections each exhibiting a first width and a central section between the end sections and exhibiting a second width smaller than the first width. The opposing fabric sides are each attached to the ridgeline and the fabric platform, and each exhibit another quadrilateral peripheral shape. The opposing fabric ends are each attached to the opposing fabric sides and the fabric platform, and each exhibit a triangular peripheral shape. The parabolic support structures extend along and are attached to the opposing fabric sides. Each of the parabolic support structures individually have ends attached to the ridgeline and a vertex proximate an edge of the central section of the fabric platform. The one or more fastening structures are attached to one or more of the opposing fabric sides, and are located adjacent one or more of the parabolic support structures. The one or more fastening structures facilitate the formation of one or more closable openings in the one or more opposing fabric sides.

In yet additional embodiments, a camping system comprises a hammock tent and one or more spreader bars. The hammock tent comprises a ridgeline and a tent body attached to the ridgeline. The tent body comprises a platform, opposing sides attached to the ridgeline and opposing concave edges of the platform, opposing ends attached to the opposing sides and opposing non-arcuate edges of the platform, and opposing support structures attached to the opposing sides and extending in an arcuate path from opposing ends attached to the ridgeline to an apex proximate a central section of the platform. The one or more spreader bars are configured to couple to and extend between coupling members attached to interior surfaces of the tent body. Each of the coupling members is individually positioned along the arcuate path of one of the opposing support structures.

DETAILED DESCRIPTION

Figure 1:
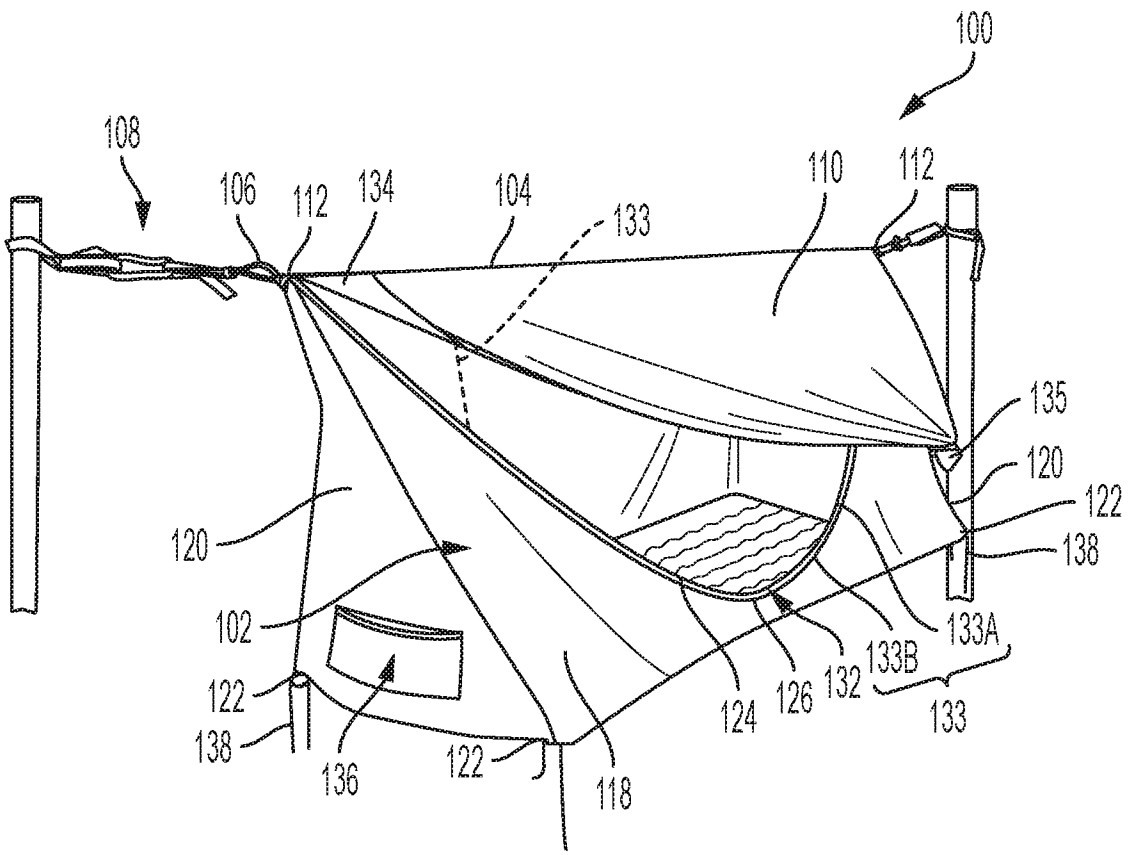
FIG. 1 is a perspective view of a hammock tent, in accordance with embodiments of the disclosure.

Hammock tents are described, as are related camping systems. In some embodiments, a hammock tent includes a ridgeline and tent body affixed to and suspended below the ridgeline. The tent body includes a platform extending generally parallel to the ridgeline, and opposing sides extending between the ridgeline and the platform. Support structures extend along and are affixed to (e.g., effectively permanently affixed to, such as sewn to) the opposing sides of the tent body. The support structures may, for example, each exhibit a parabolic shape including terminal ends located at points along the ridgeline and a vertex (e.g., apex) located at a central point along an edge of the platform of the tent body. One or more fastening structures (e.g., zippers) may extend adjacent one or more (e.g., each) of the support structures on one or more (e.g., one, each) of the opposing sides of the tent body, to facilitate access to an internal portion (e.g., bedding chamber) of the hammock tent by way of closable openings. Portions of the opposing sides of the tent body positioned above the support structures may form an integral canopy (e.g., rainfly, insect netting) of the hammock tent, wherein sections of the canopy positioned adjacent the fastening structures serve as entrance flaps (e.g., door flaps, doors) for the hammock tent. In addition, the platform of the tent body may exhibit an elongate, quadrilateral cross-sectional shape including a relatively narrow central section disposed between two relatively wider end sections. The platform may taper inward from the end sections thereof to the central section thereof. The shapes of the support structures and the platform may minimize sag in the platform and to maintain a lay flat (e.g., level) profile under load. Optionally, the hammock tent may also include one or more additional structures (e.g., spreader bars, storage structures, sleeping pad pockets, etc.) located in, on, or over the tent body. The hammock tent of the disclosure, including the support structures thereof, may be more durable, stable, and/or be better able to distribute tensional forces between the ridgeline and the platform than conventional sleeping hammocks. Moreover, the hammock tent design may enable anchors to be set at a wider range of hang angles (e.g., between about 0° and about 45°).

The following description provides specific details, such as material types, shapes, sizes, and arrangements in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow for manufacturing a structure or assembly. The structures described below do not necessarily form a complete structure or a complete assembly. Only those process acts and structures necessary to understand the embodiments of the disclosure are described in detail below. Additional acts to form a complete structure or a complete assembly from various structures described herein may be performed by conventional fabrication processes.

Drawings presented herein are for illustrative purposes only, and are not meant to be actual views of any particular material, component, structure, device, or assembly. Variations from the shapes depicted in the drawings as a result, for example, of manufacturing processes and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the claims. The drawings are not necessarily to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or methods, but also include the more restrictive terms "consisting of" and "consisting essentially of" and grammatical equivalents thereof. As used herein, the term "may" with respect to a material, structure, feature or method indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "and" and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath," or "under," or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped, etc.) and the spatially relative descriptors used herein interpreted accordingly.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, at least 99.9% met, or even 100.0% met.

As used herein, "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the term "configured" refers to a size, shape, material composition, orientation, and arrangement of one or more of at least one structure and at least one apparatus facilitating operation of one or more of the at least one structure and the at least one apparatus in a predetermined way.

Figure 2:
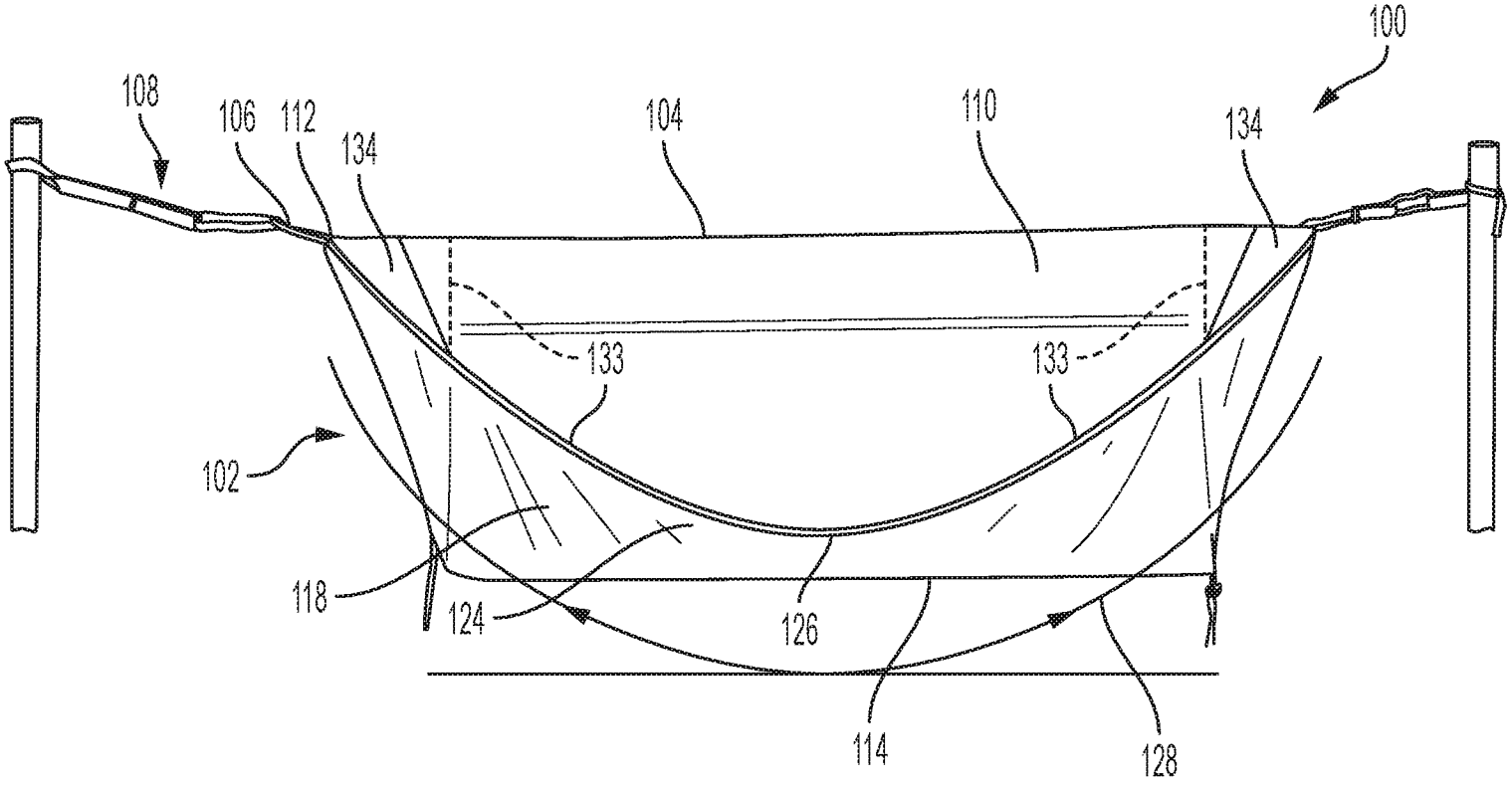
FIG. 2 is a side elevation view of the hammock tent shown in FIG. 1.
Figure 3:
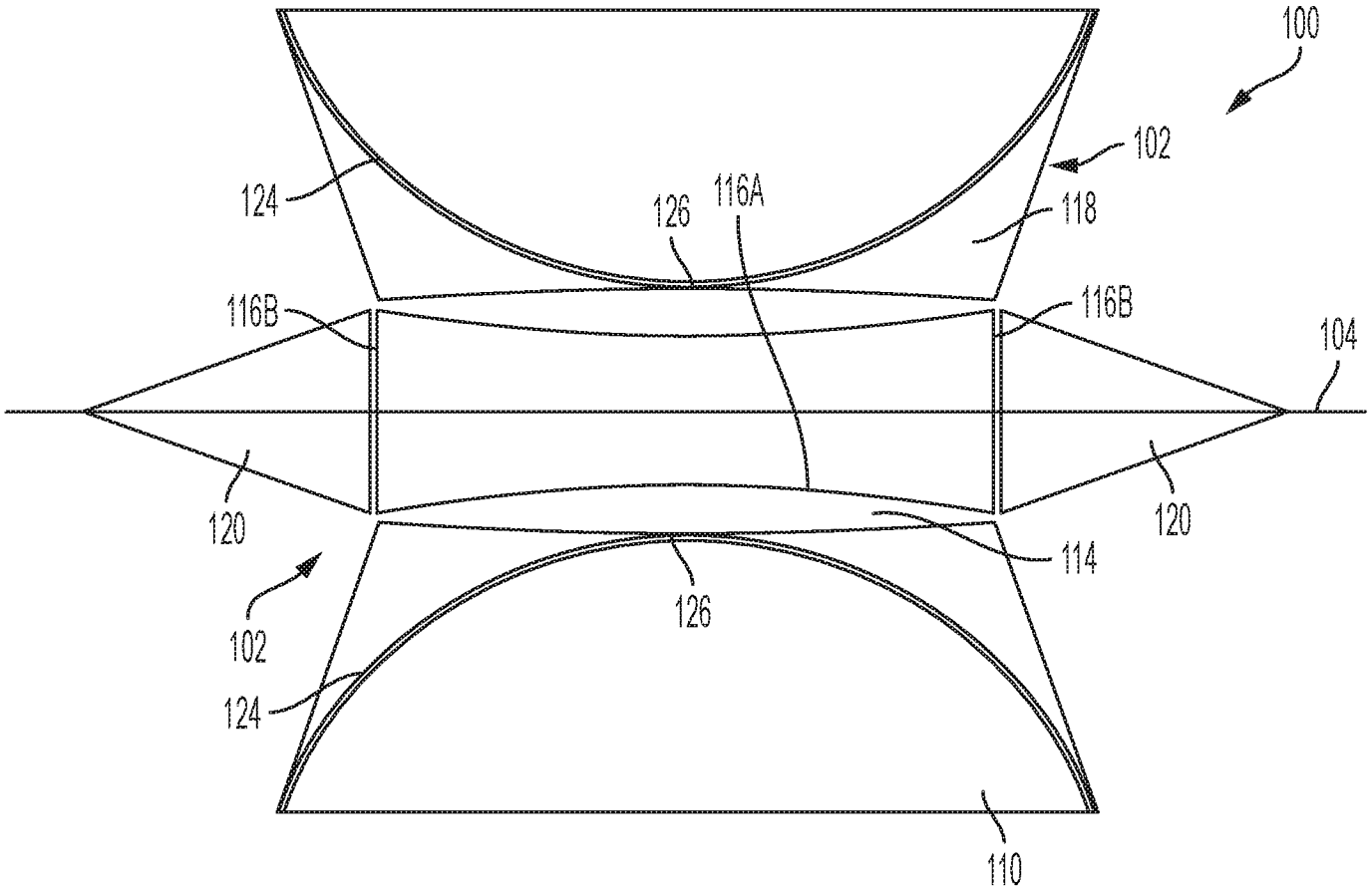
FIG. 3 is a top-down schematic view of the hammock tent shown in FIG. 1.

FIG. 1 illustrates a perspective view of a hammock tent 100, in accordance with an embodiment of the disclosure. The hammock tent 100 includes a ridgeline 104, and a tent body 102 attached to (e.g., effectively permanently attached to) and the ridgeline 104. The tent body 102 may be suspended below the ridgeline 104 during use and operation of the hammock tent 100. The ridgeline 104 may include mounting structures 106 (e.g., looped ends) for attachment to anchors 108. The anchors 108 may be a component of an attachment assembly including suspension equipment (e.g., ropes, straps, anchors, etc.) for anchoring the ridgeline 104 to additional structures (e.g., trees, posts, poles, etc.). Non-limiting examples of connectors that may be used to couple the anchors 108 to the mounting structures 106 of the ridgeline 104 include carabiners, hooks, hoops, U-bolts, and other mechanical fasteners. The anchors 108 may be used to suspend the ridgeline 104 between two structures (e.g., generally vertical structures, such as trees, posts, poles, etc.) for suspending the tent body 102 off a ground surface. FIGS. 2 and 3 are side elevation (FIG. 2) and top-down schematic (FIG. 3) views the hammock tent 100 shown in FIG. 1. For clarity and ease of understanding the drawings and related description, in FIG. 3, different components of the hammock tent 100 are shown in a spread-out state, without attachment interfaces (e.g., seams) between and coupling edges of the different components of the hammock tent 100.

Referring to FIG. 1, the ridgeline 104 is configured to be under tension when the tent body 102 of the hammock tent 100 is under load. In some embodiments, the ridgeline 104, including the mounting structures 106 thereof, comprises a single, continuous structure formed of and including at least one material exhibiting desirable properties (e.g., strength, durability, weight, pliability, flexibility, etc.) for the use and operation of the hammock tent 100. As a non-limiting example, the ridgeline 104 may be formed of and include one or more of nylon, polyester, polyurethane, neoprene, and vinyl. The ridgeline 104 may include fibers of the material arranged in one or more tows. In turn, the tows may be grouped (e.g., woven, knitted, bunched, braided, twisted, etc.) together as desired. For example, the ridgeline 104 comprise one or more of a webbing structure, a banding structure, a ribbon structure, a strapping structure, a fabric structure, a cord structure, a cable structure, and a rope structure. In some embodiments, the ridgeline 104 comprises a nylon webbing structure.

Referring collectively to FIGS. 1 through 3, the tent body 102 of the hammock tent 100 includes a platform 114 (e.g., a fabric platform), opposing sides 118 (e.g., opposing fabric sides), and opposing ends 120 (e.g., opposing fabric ends). The platform 114 may comprise a base structure (e.g., bottom structure) of the tent body 102 underlying the ridgeline 104. The opposing sides 118 may be positioned adjacent first opposing edges of the platform 114, and may extend from and between the platform 114 and the ridgeline 104. The opposing ends 120 may be positioned adjacent second opposing edges of the platform 114, and may also extend from and between the platform 114 and the ridgeline 104. The opposing ends 120 may laterally intervene between the opposing sides 118. In some embodiments, the platform 114, each of the opposing sides 118, and each of the opposing ends 120 comprise discrete structures affixed (e.g., sewn, stitched, adhered, bonded, taped, etc.) to one another. In additional embodiments, two or more of the platform 114, at least one (e.g., each) of the opposing sides 118, and at least one (e.g., each) of the opposing ends 120 comprise different portions of a single (e.g., only one) integral and continuous structure. Put another way, two or more of the platform 114, at least one of the opposing sides 118, and at least one of the opposing ends 120 may be substantially free of seams intervening therebetween. At least a portion of each of the opposing sides 118 of the tent body 102 may be attached (e.g., sewn, stitched, adhered, bonded, taped) to the ridgeline 104.

Referring to FIG. 3, the platform 114 (e.g., fabric platform, sleeping platform, base) of the tent body 102 exhibits a quadrilateral peripheral (e.g., outermost) shape including a relatively narrow central section disposed between two relatively wider end sections. The platform 114 may taper inward from the end sections thereof to the central section thereof. As shown in FIG. 3, first opposing edges 116A of the platform 114 may each exhibit an arcuate (e.g., concave) shape, and second opposing edges 116B of the platform 114 may each exhibit a substantially non-arcuate (e.g., substantially linear) shape. The first opposing edges 116A of the platform 114 may located adjacent edges of the opposing sides 118 of the tent body 102; and the second opposing edges 116B of the platform 114 may be located adjacent the edges of the opposing ends 120 of the tent body 102. In some embodiments, the first opposing edges 116A of the platform 114 are sewn to edges of the each of the opposing sides 118 of the tent body 102, and the second opposing edges 116B of the platform 114 are sewn to edges of each of the opposing ends 120 of the tent body 102. Corners 122 may intervene between the first opposing edges 116A and the second opposing edges 116B of the platform 114. The corners 122 may exhibit any desired shape, such as a rounded (e.g., arcuate, radiused) shape, a non-rounded (e.g., angled) shape, or a combination thereof.

The platform 114 of the tent body 102 may be formed of and include at least one material exhibiting desirable properties (e.g., strength, durability, water resistance, weight, pliability, flexibility, etc.) for the use and operation of the hammock tent 100. By way of non-limiting example, the platform 114 may be formed of and include one or more of nylon (e.g., treated ripstop, taffeta nylon, etc.), polyester, polyurethane, neoprene, vinyl, cotton, hemp, and a composite material. In some embodiments, the platform 114 of the tent body 102 comprises a material (e.g., a treated material, an untreated material) that is substantially water resistant. The platform 114 may include fibers of the material arranged in one or more tows. In turn, the tows may be grouped (e.g., woven, knitted) together as desired. For example, the platform 114 may comprise a woven fabric or a knitted fabric. In some embodiments, the platform 114 comprises a woven fabric. A material composition of the platform 114 may be substantially the same as or may be different than that of one or more of opposing sides 118 and the opposing ends 120 of the tent body 102. In some embodiments, the platform 114 comprises a different (e.g., heavier) material than the opposing sides 118 and the opposing ends 120 of the tent body 102.

As shown in FIGS. 1 and 3, the opposing ends 120 (e.g., opposing fabric ends) of the tent body 102 may each individually exhibit a substantially triangular (e.g., isosceles or equilateral) shape. Lowermost edges of the opposing ends 120 may be located adjacent the second opposing edges 116B (FIG. 3) of the platform 114 of the tent body 102; and side edges of the opposing ends 120 may be located adjacent side edges of the opposing sides 118 of the tent body 102. In some embodiments, the lower edges of the opposing ends 120 are sewn to the second opposing edges 116B (FIG. 3) of the platform 114 of the tent body 102, and the side edges of the opposing ends 120 are sewn to the side edges of opposing sides 118 of the tent body 102. In some embodiments, portions (e.g., upper corners) of each of the opposing ends 120 are directly attached (e.g., sewn) to the ridgeline 104. In additional embodiments, the opposing ends 120 are each indirectly attached (e.g., attached by way of one or more structures connected thereto, such as the opposing sides 118) to the ridgeline 104.

The opposing ends 120 of the tent body 102 may each individually be formed of and include at least one material exhibiting desirable properties (e.g., strength, durability, water resistance, weight, pliability, flexibility, etc.) for the use and operation of the hammock tent 100. By way of non-limiting example, the opposing ends 120 may each individually be formed of and include one or more of nylon, polyester, polyurethane, neoprene, vinyl, cotton, hemp, and a composite material. In some embodiments, the opposing ends 120 of the tent body 102 each comprise a material (e.g., a treated material, an untreated material) that is substantially water resistant. The opposing ends 120 may include fibers of the material arranged in one or more tows. In turn, the tows may be grouped (e.g., woven, knitted) together as desired. For example, the opposing ends 120 may comprise one or more of a woven fabric and a knitted fabric. In some embodiments, the opposing ends 120 each comprise a woven fabric. The opposing ends 120 may have substantially the same material composition or different material compositions than one another. In addition, the material composition of the opposing ends 120 may be substantially the same as or may be different than that of one or more of the platform 114 and opposing sides 118 of the tent body 102.

As shown in FIGS. 1 through 3, the opposing sides 118 (e.g., opposing fabric sides) of the tent body 102 may each individually exhibit a quadrilateral peripheral shape (e.g., a rectangular peripheral shape, a trapezoidal peripheral shape). Lowermost edges of the opposing sides 118 may be located adjacent the first opposing edges 116A (FIG. 3) of the platform 114 of the tent body 102; and side edges of the opposing side 118 may be located adjacent the side edges of the opposing end 120 of the tent body 102. In some embodiments, the lowermost edges of the opposing sides 118 are sewn to the first opposing edges 116A (FIG. 3) of the platform 114 of the tent body 102, and the side edges of the opposing sides 118 are sewn to the side edges of opposing end 120 of the tent body 102. In some embodiments, at least a portion of each of the opposing sides 118 is directly attached (e.g., sewn) to the ridgeline 104.

The opposing sides 118 of the tent body 102 may each individually be formed of and include at least one material exhibiting desirable properties (e.g., strength, durability, water resistance, weight, pliability, flexibility, etc.) for the use and operation of the hammock tent 100. By way of non-limiting example, the opposing sides 118 may each individually be formed of and include one or more of nylon, polyester, polyurethane, neoprene, vinyl, cotton, hemp, and a composite material. In some embodiments, the opposing sides 118 of the tent body 102 each comprise a material (e.g., a treated material, an untreated material) that is substantially water resistant. The opposing sides 118 may include fibers of the material arranged in one or more tows. In turn, the tows may be grouped (e.g., woven, knitted) together as desired. For example, major portions of each of the opposing side 118 may comprise one or more of a woven fabric and a knitted fabric. In some embodiments, major portions of the opposing side 118 each comprise a woven fabric. The opposing side 118 may have substantially the same material composition or different material compositions than one another. In addition, the material composition of major portions (e.g., major woven fabric portions) of the opposing side 118 may be substantially the same as or may be different than material compositions of one or more of the platform 114 and opposing ends 120 of the tent body 102.

With continued collective reference to FIGS. 1 through 3, support structures 124 extend along and are attached to the opposing sides 118 of the tent body 102. The support structures 124 may extend from attachment points 112 on the ridgeline 104 to locations at or proximate the relatively narrow central section of the platform 114 of the tent body 102. Opposing terminal ends of each of the support structures 124 may be effectively (e.g., absent permanent destructive action to one or more attachment structures) permanently attached (e.g., sewn, stitched, adhesively bonded) or may be removably attached (e.g., removably fastened, removably anchored, removably clipped) to the attachment points 112 along the ridgeline 104. In addition, the support structures 124 may be directly attached (e.g., sewn) to the opposing sides 118 of the tent body 102, or may be disposed within another structure (e.g., a sleeve structure) directly attached to or integral with the opposing sides 118 of the tent body 102. The support structures 124 may be attached to one or more of exterior (e.g., outer) surfaces and interior (e.g., inner) surfaces of the opposing sides 118 of the tent body 102. In some embodiments, the support structures 124 are sewn to exterior surfaces of the opposing sides 118 of the tent body 102. In additional embodiments, the support structures 124 are sewn to interior surfaces of the opposing sides 118 of the tent body 102.

The support structures 124 may be formed of and include one or more materials exhibiting desirable properties (e.g., strength, durability, weight, pliability, flexibility, etc.) for the use and operation of the hammock tent 100. By way of non-limiting example, the support structures 124 may be formed of and include one or more of nylon, polyester, polyurethane, neoprene, and vinyl. The support structures 124 may include fibers of the material arranged in one or more tows. In turn, the tows may be grouped (e.g., woven, knitted, bunched, braided, twisted, etc.) together as desired. For example, the support structures 124 comprise one or more of webbing structures, ribbon structures, strapping structures, fabric structures, cord structures, cable structures, and rope structures. In some embodiments, the support structures 124 comprise nylon webbing structures.

As shown in each of FIGS. 1 through 3, the support structures 124 may each individually exhibit a parabolic shape including two opposing ends located at different attachment points 112 than one another along the ridgeline 104, and an apex 126 (e.g., a vertex) at or proximate a centerline of the platform 114. The parabolic shape of the support structures 124, as well as the relatively narrow width of the central section of the platform 114 (e.g., as compared the widths of the end sections of the platform 114), may substantially limit sagging of the central section of the platform 114 during use and operation of the hammock tent 100. The parabolic shape of the support structures 124 may, for example, distribute tensional forces between the ridgeline 104 and the platform 114 in the manner depicted by the phantom line 128 shown in FIG. 2. In additional embodiments, one or more (e.g., each) of the support structures 124 may exhibit a non-parabolic shape that impedes (e.g., substantially prevents) sagging of the central section of the platform 114. As a non-limiting example, at least one (e.g., each) of the support structures 124 may exhibit a different arcuate profile (e.g., a non-parabolic arcuate profile, such as a non-parabolic inverted arc profile). As another non-limiting example, at least one (e.g., each) of the support structures 124 may exhibit a V-shaped profile. As an additional non-limiting example, at least one of the support structures 124 may exhibit a different shape having multiple (e.g., three) portions (e.g., multiple apexes, multiple ends, etc.) at or proximate the first opposing edges 116A (FIG. 3) of the platform 114.

With continued reference to FIGS. 1 through 3, upper portions of the opposing sides 118 positioned above the support structures 124 may form a canopy 110 of the hammock tent 100. The canopy 110 may be affixed (e.g., sewn, stitched, adhered, bonded, etc.) to the ridgeline 104. In some embodiments, canopy 110 comprises a single (e.g., only) structure (e.g., a single piece of fabric) attached to the ridgeline 104 and operatively associated with (e.g., removably fastened to) lower portions of the opposing sides 118 of the tent body 102. In additional embodiments, the canopy 110 comprises multiple (e.g., more than one) structures (e.g., multiple pieces of fabric) attached to the ridgeline 104 and operatively associated with (e.g., removably fastened to) the lower portions of the opposing sides 118 of the tent body 102. For example, the canopy 110 may comprise two separate pieces of fabric attached (e.g., sewn) to the ridgeline 104, wherein one of the pieces is operatively associated with a first of the opposing sides 118 of the tent body 102, and the other of the pieces is operatively associated with a second of the opposing sides 118 of the tent body 102. As another example, the canopy 110 may comprise multiple pieces of fabric in a stacked relationship with one another. At least one lower portion of the canopy 110 may, for example, comprise a mesh fabric (e.g., nylon mesh) configured to protect against insects while enabling adequate visibility and air flow; and at least one upper portion of the canopy 110 overlying the lower portion of the canopy 110 may, for example, comprise a lightweight, water-resistant (e.g., substantially water-proof) fabric (e.g., nylon fabric, polyester fabric, etc.) configured to shield against one or more of rain, wind, and direct sunlight. In such embodiments, the lower portion and the upper portion of the canopy 110 may each individually be attached (e.g., sewn) to the ridgeline 104 and may be operatively associated with (e.g., removably fastened to) the lower portions of the opposing sides 118 of the tent body 102.

As shown in FIG. 1, one or more (e.g., each) of the opposing sides 118 of the tent body 102 may exhibit fastening structures 133 attached thereto that facilitate access to an interior region of the tent body 102. The fastening structures 133 may, for example, include one or more of zippers, ties, clips, rivets, buttons, hooks and loops, and straps having hook and eye connections (e.g., VELCRO® straps). In some embodiments, at least one of the fastening structures 133 comprises a single, continuous zipper extending along the path at least one of the support structures 124. The fastening structures 133 may be located along edges of the opposing sides 118 proximate upper edges the support structures 124. For example, lower portions (e.g., lower zipper teeth) of the fastening structures 133 may be attached to upper edges of lower portions of the opposing sides 118 of the tent body 102 located adjacent upper edges of the support structures 124, and upper portions (e.g., upper zipper teeth) of the fastening structures 133 may be attached to lower edges of the canopy 110 located proximate the support structures 124 when the tent body 102 is in a closed state. In additional embodiments, the path of at least one (e.g., each) of the fastening structures 133 does not completely follow the path of the support structure 124 most proximate thereto. Upper portions (e.g., portions proximate the ridgeline 104) of the fastening structures 133 (and, hence, edges of the opposing sides 118 proximate thereto) may, for example, deviate from the paths of upper portions (e.g., portions extending from and proximate the attachment points 112 along the ridgeline 104) of the of the support structures 124. By way of non-limiting example, upper portions of the fastening structures 133 (and, hence, edges of the opposing sides 118 proximate thereto) may extend from points along the ridgeline 104 laterally inward of the attachment points 112, such that the upper portions of fastening structures 133 extend substantially orthogonal to the ridgeline 104, as depicted by dashed lines in FIGS. 1 and 2. Extending upper portions of the fastening structures 133 substantially orthogonal to the ridgeline 104 may simplify opening and closing the tent body 102 from an interior region (e.g., bedding chamber) thereof. In embodiments wherein the canopy 110 includes a stack of multiple pieces of fabric (e.g., insect netting, and a rainfly overlying the insect netting) inner fastening structures 133A may be configured and positioned to secure lower portions (e.g., insect netting) of the canopy 110 to the lower portions of the opposing sides 118 of the tent body 102, and outer attachment structures 133B may be configured and positioned to secure outer portions (e.g., a rainfly) of the canopy 110 to the lower portions of the opposing sides 118 of the tent body 102. Each of the opposing sides 118 of the tent body 102 may exhibit fastening structures 133 attached thereto, or only one of the of the opposing sides 118 of the tent body 102 may exhibit fastening structures 133 attached thereto.

Acting upon the fastening structures 133 facilitates forming (or closing) at least one opening 132 in the tent body 102. For example, if the fastening structures 133 comprise zippers, unzipping the fastening structures 133 may form the opening 132 in the tent body 102, and zipping the fastening structures 133 may close the opening 132. The fastening structures 133 may be acted upon (e.g., zipped, unzipped) from inside the tent body 102 and from outside the tent body 102. At least one section of the canopy 110 proximate the fastening structures 133 may serve as an entrance flap (e.g., door flap, door) for the tent body 102 of the hammock tent 100. In addition, the canopy 110 may have at least one tether structure 135 (e.g., loop, strap, rope, banding, cord, carabiner, hook, hoop, U-bolt, mechanical fastener, combinations thereof) attached thereto for securing sections of the canopy 110 serving as an entrance flap in an open position (e.g., a position wherein the opening 132 in the tent body 102 is present). As shown in FIG. 1, the tether structure 135 may, for example, be secured to one or more additional structures (e.g., a tree, a post, a pole, etc.) to provide cover (e.g., protection from precipitation, protection from sunlight) for the outside area leading into the opening 132 in the tent body 102. In embodiments wherein the only one of the opposing sides 118 of the tent body 102 includes fastening structures 133 attached thereto, a single (e.g., only one) opening 132 may be formed in the tent body 102 by way of the fastening structures 133. In additional embodiments wherein each of the opposing sides 118 of the tent body 102 includes fastening structures 133 attached thereto, multiple (e.g., more than one, such as two) openings 132 may be formed in the tent body 102 by way of the fastening structures 133.

With continued reference to FIG. 1, edges of the opposing sides 118 at least partially defining the openings 132 may, optionally, be shielded with at least one protective covering 134. For example, one or more pieces of material (e.g., water resistant fabric, rubber, etc.) may cover one or more portions of the fastening structures 133 employed to form (and close) the openings 132 to impede (e.g., prevent) moisture from entering (e.g., seeping, leaking) into the interior region of the tent body 102. In some embodiments, when the fastening structures 133 are in a closed state, the protective covering 134 extends over and past one or more portions of the fastening structures 133 by about 1 inch to about 6 inches (e.g., from about 2 inches to about 4 inches). The protective covering 134 may, for example, be attached (e.g., sewn) to portions of the canopy 110 proximate the fastening structures 133. In some embodiments, the protective covering 134 partially extends across the path(s) of the fastening structures 133 to cover less than an entirety of the fastening structures 133 when the fastening structures 133 are in a closed state. For example, the protective covering 134 may only cover portions of the fastening structures 133 proximate (e.g., within about 24 inches, such as within about 18 inches, such as within about 12 inches) the ridgeline 104. In additional embodiments, the protective covering 134 substantially completely extends across the path(s) of the fastening structures 133, to substantially completely cover the fastening structures 133 when the fastening structures 133 are in a closed state.

With continued reference to FIG. 1, optionally, the hammock tent 100 may also include one or more storage structures 136. The storage structures 136 may include one or more structures (e.g., pouches, pockets, compartments, straps, gear hooks, etc.) for storing items outside and/or within the tent body 102. In some embodiments, one or more storage structures 136 are attached to one or more external surfaces of the tent body 102, such as one or more external surfaces of one or more of the opposing ends 120 of the tent body 102. In additional embodiments, one or more storage structures 136 are attached to one or more internal surfaces of the tent body 102, such as one or more internal surfaces of one or more of the opposing ends 120 of the tent body 102.

As shown in FIG. 1, the hammock tent 100 may, optionally, further include additional attachment structures 138 (e.g., ties, straps, loops, etc.) that may be coupled to other structures to provide additional stability to the hammock tent 100. If present, the additional attachment structures 138 may extend from external surfaces of the tent body 102, such as from locations proximate at least some (e.g., two, four) of the corners 122 of the platform 114.

Figure 4:
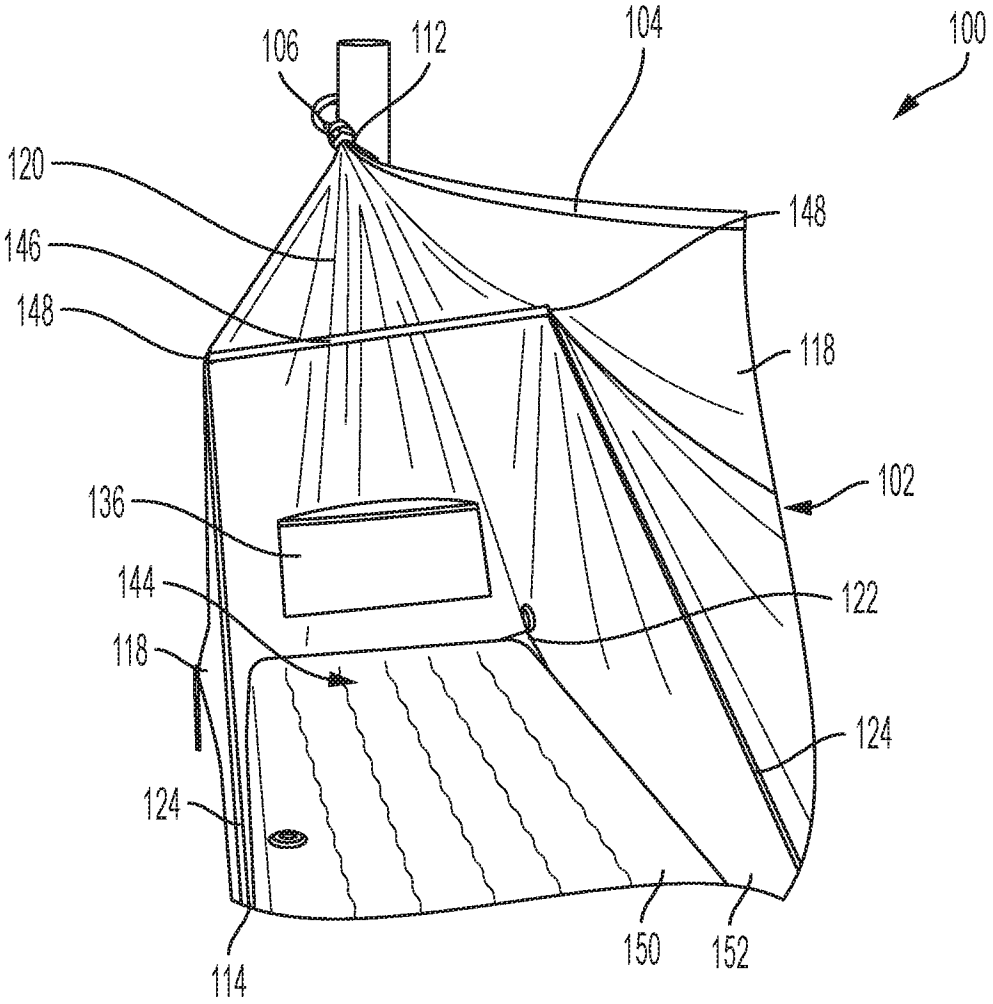
FIG. 4 is perspective view of an interior portion of the hammock tent shown in FIG. 1.

FIG. 4 illustrates a partial perspective view of an interior region 144 of the hammock tent 100 during use and operation thereof. The interior region 144 may, for example, serve as a bedding chamber (e.g., sleeping region) for one or more individuals (e.g., occupants, people) during use and operation of the hammock tent 100. The interior region 144 may be at least partially defined by interior surfaces of the platform 114, the opposing sides 118, and the opposing ends 120 of the tent body 102. The interior region 144 may also contain (e.g., hold, bound) one or more additional structures (e.g., spreader bars, bedding pads, storage structures, etc.), as described in further detail below.

As shown in FIG. 4, one or more spreader bars 146 may, optionally, be provided within the interior region 144 of the hammock tent 100 during the use and operation of the hammock tent 100. The spreader bars 146 may comprise elongate structures (e.g., rods, poles, shafts) configured and positioned to expand (e.g., widen, broaden) the separation between upper portions of the opposing sides 118 of the tent body 102. Opposing ends of each spreader bar 146 may be positioned adjacent to the support structures 124 attached to the opposing sides 118 of the tent body 102. Each spreader bar 146 may substantially laterally extend between the support structures 124 in a direction transverse to that of the ridgeline 104 of the hammock tent 100. The opposing ends of each spreader bar 146 may be removably secured to interior surfaces of the opposing sides 118 of the tent body 102 and/or interior surfaces of the support structures 124 with coupling members 148 positioned along the paths of the support structures 124. The coupling members 148 (e.g., washers, nuts, T-nuts, rivets, etc.) may be positioned and configured to retain the spreader bars 146 against and between the support structures 124 as the opposing sides 118 move and shift under load. Each spreader bar 146 may individually be formed of and include a rigid material, such as one or more of a metal material, a polymeric (e.g., plastic) material, a ceramic material, and a solid organic material (e.g., wicker, wood, etc.). Each spreader bar 146 may be configured to withstand compressive forces, and may be positioned to distribute (e.g., redirect) at least a portion of the load to the support structures 124. In some embodiments, the hammock tent 100 includes at least two spreader bars 146, with at least one of the spreader bars 146 being positioned proximate one of the opposing ends 120 of the tent body 102 during use and operation of the hammock tent 100, and at least one other of the spreader bars 146 positioned proximate the other of the opposing ends 120 of the tent body 102 during use and operation of the hammock tent 100. In additional embodiments, the hammock tent 100 includes only one (e.g., a single) spreader bar 146 positioned proximate only one of the opposing ends 120 of the tent body 102 during use and operation of the hammock tent 100. In additional embodiments, the hammock tent 100 is free of any spreader bars 146 (e.g., the spreader bars are absent from the hammock tent 100).

With continued reference to FIG. 4, a bedding pad 150 (e.g., an air mattress, a foam pad) may, optionally, be provided within the interior region 144 during use and operation of the hammock tent 100. The bedding pad 150 may be provided over an interior surface of the platform 114 of the tent body 102, and may laterally extend between each of the opposing sides 118 and each of the opposing ends 120 of the tent body 102. In some embodiments, the tent body 102 is configured such that the apex 126 of each of the support structures 124 is positioned below an upper surface of the bedding pad 150 during use and operation of the hammock tent 100. The apexes 126 of the support structures 124 may, for example, be positioned directly at the first opposing edges 116A (FIG. 3) of the platform 114 of the tent body 102. In additional embodiments, the tent body 102 is configured such the apexes 126 of the support structures 124 are positioned above the upper surface of the bedding pad 150 during use and operation of the hammock tent 100. Portions of the opposing sides 118 of the tent body 102 may intervene between the apexes 126 of the support structures 124 and first opposing edges 116A (FIG. 3) of the platform 114. For example, the apex 126 of each of the support structures 124 may be offset from one of the first opposing edges 116A (FIG. 3) of the platform 114 most proximate thereto by a distance within a range of from about 1 inch to about 6 inches (e.g., from about 2 inches to about 6 inches, from about 2 inches to about 5 inches, or from about 2 inches to about 4 inches). In such embodiments, the bedding pad 150 may be substantially laterally surrounded by the material of the opposing sides 118 and the opposing ends 120 of the tent body 102 during use and operation of the hammock tent 100, even when the opening 132 is formed in at least one of the opposing sides 118 by way of the fastening structures 133 (FIG. 1) (e.g., zippers) operatively associated therewith. Accordingly, lower portions of the opposing sides 118 and the opposing ends 120 may form a bedding pocket 152 for the bedding pad 150. Positioning the apexes 126 of the support structures 124 above the bedding pad 150 may enhance the ease and simplicity of accessing the interior region 144 of the hammock tent 100 by way of the openings 132. For example, providing the apexes 126 of the support structures 124 above the bedding pad 150 may preclude the sides of the bedding pad 150 from impeding the movement of devices (e.g., one or more sliders) of the fastening structures 133 (FIG. 1) (e.g., zippers) past the bedding pad 150 when it is desired to access the interior region 144 of the hammock tent 100 by way of the openings 132.

Figure 5B:
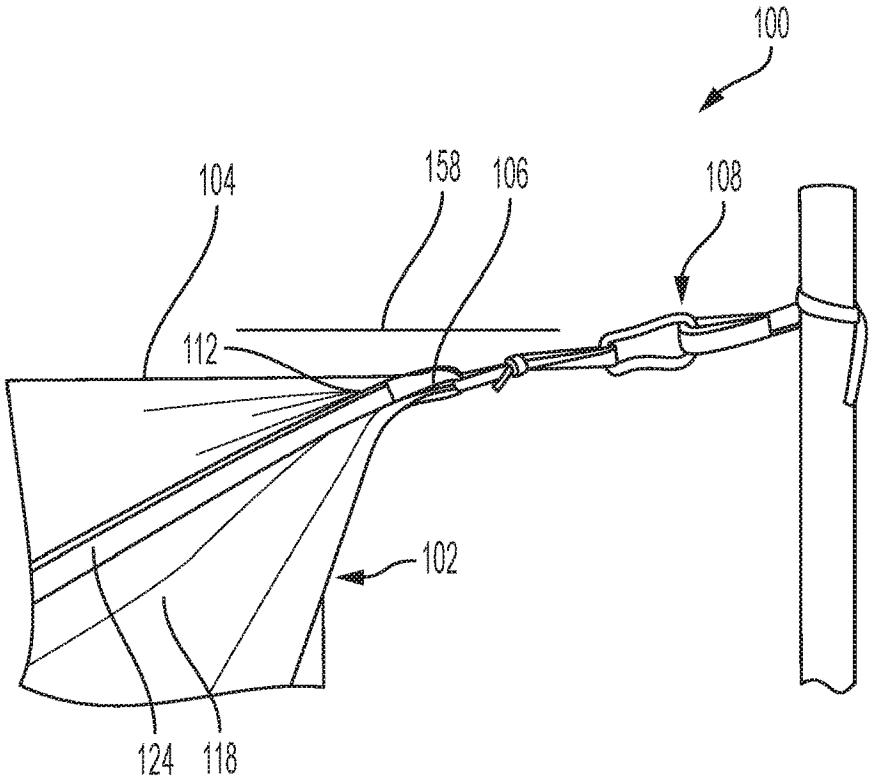
FIGS. 5A and 5B are perspective views of a portion of the hammock tent shown in FIG. 1.
Figure 5A:
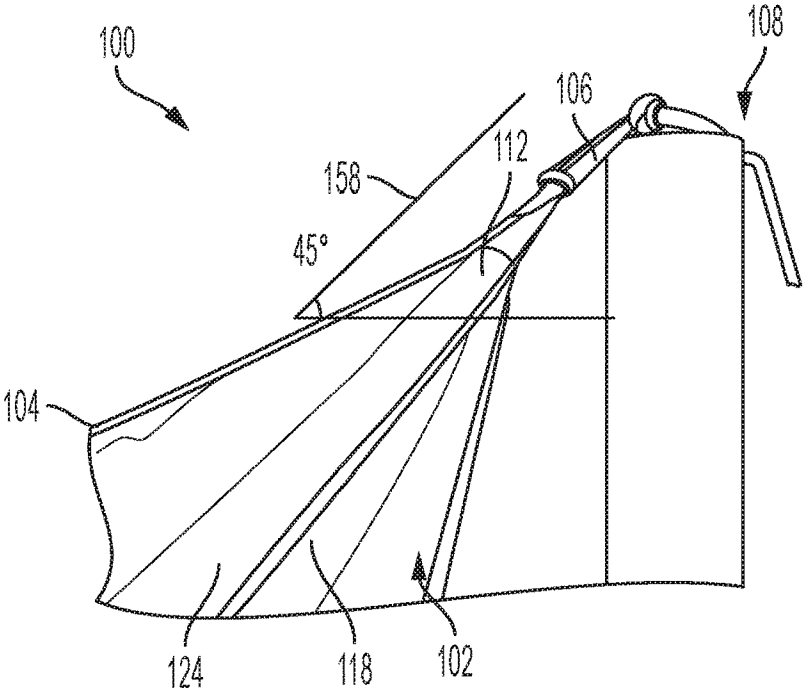

FIGS. 5A and 5B are perspective views of a portion of the hammock tent 100 shown in FIG. 1 during use and operation of the hammock tent 100. FIGS. 5A and 5B show enlarged views of the attachment points 112, and the mounting structures 106 of the ridgeline 104, and the anchors 108 previously discussed above with reference to FIG. 1. As discussed above, the support structures 124 of the tent body 102 of the hammock tent 100 may be attached to the ridgeline 104 at the attachment points 112 of the ridgeline 104, and the mounting structures 106 may be indirectly attached to the anchors 108. Since tensional forces are distributed between the ridgeline 104 and the platform 114 (FIGS. 1 through 3) of the tent body 102 using the support structures 124, the hammock tent 100 may be suspended using a wider range of hang angles 158 (e.g., attachment angles) of the anchors 108 as compared to conventional hammock tent configurations. By way of non-limiting example, the ridgeline 104 may be suspended from the anchors 108 when the anchors 108 that are set at a hang angle 158 within a range of from about 0 degrees to about 45 degrees relative to a horizontal plane of the platform 114 (e.g., level sleeping platform). Conversely, most conventional hammock systems require a hang angle of about 30 degrees. As shown in FIG. 5A, in some embodiments, the hammock tent 100 is suspended above the ground when the anchors 108 are attached to support structures at a hang angle 158 of about 45 degrees. As shown in FIG. 5B, in additional embodiments, the hammock tent 100 is suspended above the ground when the anchors 108 are attached to support structures at a hang angle 158 of about 45 degrees. Thus, the anchors 108 may each individually be set at a hang angle 158 within a range of from 0 degrees to about 45 degrees relative to horizontal, while enabling a lay flat (e.g., level) profile of the platform 114 (FIGS. 1 through 3) of the hammock tent 100 under load.

Optionally, the mounting structures 106 and/or the anchors 108 may be configured and positioned for attachment to portable structural supports (e.g., tent poles, such as collapsible tent poles) for instances when structures (e.g., stationary structures, such as trees, embedded posts, embedded poles, etc.) capable of suspending the hammock tent 100 above a surface of the ground are unavailable, and it is desired to utilize the hammock tent 100 on the ground. In such embodiments, the platform 114 (FIGS. 1 through 3) of the tent body 102 may at least partially rest on the ground during use and operation of the hammock tent 100, with support being provided to upper portions of the tent body 102 by way of structural supports (e.g., tent poles) extending between the ground and one or more of the ridgeline 104, the mounting structures 106, and the anchors 108.

Outdoor camping structures including hammock tents (e.g., the hammock tent 100) in accordance with embodiments of the disclosure may be used in embodiments of camping systems of the disclosure. Such camping systems may, for example, include the hammock tent 100 previously described in relation to FIGS. 1 through 5B, as well as one or more additional structures and/or devices. By way of non-limiting example, a camping system of the disclosure may include the hammock tent 100 (including the tent body 102 and the ridgeline 104 thereof), and a containment vessel (e.g., bag, backpack, etc.) for holding and storing the hammock tent 100. The hammock tent 100 may, for example, be readily manipulated (e.g., folded, rolled, compressed) for placement within an internal chamber of the containment vessel. The combination of the hammock tent 100 and the containment vessel may be relatively light weight (e.g., less than or equal to about 10 pounds, such as less than or equal to about 5 pounds, or less than or equal to about 3 pounds), facilitating simple transport and use of the hammock tent 100 for a wide variety of applications (e.g., hiking, camping, mountaineering, on-foot excursions, etc.).

The hammock tents (e.g., the hammock tent 100) and camping systems of the disclosure may be more durable, comfortable (e.g., facilitating a more flat sleeping surface), stable, efficient (e.g., including fewer discrete parts to manage and arrange; having improved distribution of forces under load; having reduced weight and bulk, etc.), and adaptable (e.g., usable under a relatively wider range of hang angles and site conditions) than conventional hammock tents and camping systems.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A hammock tent, comprising:
- a ridgeline; and
- a tent body attached to the ridgeline and comprising:
  - a platform comprising;
    - to end sections; and
    - a central section between the two end sections, the two end sections each relatively wider than the central section;
  - opposing sides attached to first opposing edges of the platform;
  - support structures attached to the opposing sides and each comprising ends attached to the ridgeline and an apex proximate the central section of the platform; and
  - opposing ends positioned between the opposing sides and attached to edges of the opposing sides and second opposing edges of the platform.

2. The hammock tent of claim 1, wherein:
- the first opposing edges of the platform each exhibit an arcuate shape; and
- the second opposing edges of the platform each exhibit a non-arcuate shape.

3. The hammock tent of claim 1, wherein each of the support structures exhibits a generally parabolic shape.

4. The hammock tent of claim 1, wherein the apex of each of the support structures is offset from one of the first opposing edges of the platform most proximate thereto by a distance within a range of from about 1 inch to about 6 inches.

5. The hammock tent of claim 1, wherein at least a major length of the ridgeline is sewn to the opposing sides of the tent body.

6. The hammock tent of claim 1, further comprising zippers attached to one or more of the opposing sides of the tent body and at least partially extending along paths of the support structures.

7. The hammock tent of claim 1, further comprising fastening structures attached to one or more of the opposing sides of the tent body, the fastening structures facilitating access to an interior region of the tent body and positioned proximate one or more of the support structures.

8. The hammock tent of claim 7, wherein the fastening structures are attached to both of the opposing sides of the tent body, the fastening structures each individually at least partially extending along a path of one of the support structures proximate thereto.

9. The hammock tent of claim 7, further comprising water resistant structures attached to one or more of the opposing sides the tent body and extending over and past the fastening structures to impede moisture from entering into the interior region of the tent body.

10. The hammock tent of claim 7, wherein upper portions of the opposing sides of the tent body extending from and between the fastening structures and the ridgeline define a canopy of the tent body, the canopy serving as an entrance flap for the tent body.

11. The hammock tent of claim 10, wherein the canopy comprises:

a lower portion comprising a mesh fabric attached to inner fastening structures; and an upper portion comprising a water resistant fabric overlying the lower portion and attached to outer fastening structures.

12. The hammock tent of claim 1, further comprising spreader bars configured to couple to and substantially extend between upper portions of a pair of the support structures.

13. A hammock tent, comprising:

a ridgeline comprising one or more of webbing, banding, ribbon, strapping, fabric, cord, cable, and rope; and a tent body attached to and configured to be suspended from the ridgeline, the tent body comprising:

a fabric platform comprising:

end sections each exhibiting a first width;

a central section between the end sections and exhibiting a second width smaller than the first width;

opposing fabric sides each attached to the ridgeline and the fabric platform and each exhibiting a quadrilateral peripheral shape;

opposing fabric ends each attached to the opposing fabric sides and the fabric platform and each exhibiting a triangular peripheral shape;

parabolic support structures extending along and attached to the opposing fabric sides, each of the parabolic support structures individually having ends attached to the ridgeline and a vertex proximate an edge of the central section of the fabric platform; and one or more fastening structures attached to one or more of the opposing fabric sides and located adjacent one or more of the parabolic support structures, the one or more fastening structures facilitating the formation of one or more closable openings in the one or more opposing fabric sides.

14. The hammock tent of claim 13, wherein the parabolic support structures are sewn to the opposing fabric sides and the ridgeline.

15. The hammock tent of claim 13, wherein the one or more fastening structures comprise one or more zippers.

16. The hammock tent of claim 13, wherein the ridgeline exhibits looped ends and is configured to be anchored at least two additional structures at hang angles of up to about 45 degrees.

17. A camping system, comprising:

a hammock tent, comprising:

a ridgeline; and a tent body attached to the ridgeline and comprising:

a platform;

opposing sides attached to the ridgeline and opposing concave edges of the platform;

opposing ends attached to the opposing sides and opposing non-arcuate edges of the platform; and opposing support structures attached to the opposing sides and extending in an arcuate path from opposing ends attached to the ridgeline to an apex proximate a central section of the platform; and one or more spreader bars configured to couple to and extend between coupling members attached to interior surfaces of the tent body, each of the coupling members individually positioned along the arcuate path of one of the opposing support structures.

18. The camping system of claim 17, further comprising portable structural supports configured to attach to and suspend the ridgeline of the hammock tent above a ground surface.

19. The camping system of claim 17, further comprising a pad configured to be provided over an interior surface of the platform within the tent body.

* * * * *